US008299421B2

(12) United States Patent
Wells

(10) Patent No.: US 8,299,421 B2
(45) Date of Patent: Oct. 30, 2012

(54) LOW-PRESSURE ELECTRON IONIZATION AND CHEMICAL IONIZATION FOR MASS SPECTROMETRY

(75) Inventor: Gregory J. Wells, Fairfield, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 222 days.

(21) Appl. No.: 12/754,475

(22) Filed: Apr. 5, 2010

(65) Prior Publication Data

US 2011/0240848 A1 Oct. 6, 2011

(51) Int. Cl.
*H01J 49/00* (2006.01)

(52) U.S. Cl. ..... 250/281; 250/282; 250/423 R

(58) Field of Classification Search ..... 250/281, 250/282, 288
See application file for complete search history.

(56) References Cited

U.S. PATENT DOCUMENTS 4,105,916 A * 8/1978 Siegel ..... 250/282
4,159,423 A * 6/1979 Kambara ..... 250/423 R
4,175,234 A * 11/1979 Hunt et al. ..... 250/427
4,686,367 A 8/1987 Louris et al.
4,771,172 A 9/1988 Weber-Grabau et al.
4,808,819 A * 2/1989 Hirose ..... 250/288
4,851,700 A * 7/1989 Goodley ..... 250/288
5,101,105 A * 3/1992 Fenselau et al. ..... 250/281
5,420,425 A 5/1995 Bier et al.
5,756,996 A 5/1998 Bier et al.
6,608,318 B1 * 8/2003 Perkins et al. ..... 250/496.1
6,808,933 B1 * 10/2004 Prest ..... 436/161
7,034,293 B2 4/2006 Wells
7,148,491 B2 * 12/2006 Perkins ..... 250/423 R
7,196,325 B2 * 3/2007 Syage ..... 250/288
7,304,299 B2 * 12/2007 Perkins ..... 250/288
2005/0194530 A1 * 9/2005 Thakur ..... 250/288
2006/0071162 A1 * 4/2006 Crawford et al. ..... 250/290
2006/0169890 A1 * 8/2006 Crawford et al. ..... 250/290
2007/0040131 A1 * 2/2007 Perkins ..... 250/492.21
2008/0185511 A1 * 8/2008 Senko ..... 250/283
2008/0245963 A1 * 10/2008 Land et al. ..... 250/288
2009/0294649 A1 * 12/2009 Shabanowitz et al. ..... 250/282
2011/0057098 A1 * 3/2011 Le Blanc ..... 250/283

* cited by examiner

*Primary Examiner* — Nikita Wells
*Assistant Examiner* — Johnnie L Smith

(57) ABSTRACT

A sample is ionized by chemical ionization by flowing the sample and a reagent gas into an ion source at a pressure below 0.1 Torr. While maintaining the ion source at a pressure below 0.1 Torr, the reagent gas is ionized in the ion source by electron ionization to produce reagent ions. The sample is reacted with the reagent ions at a pressure below 0.1 Torr to produce product ions of the sample. The product ions are transmitted into an ion trap for mass analysis.

18 Claims, 7 Drawing Sheets

LOW-PRESSURE ELECTRON IONIZATION AND CHEMICAL IONIZATION FOR MASS SPECTROMETRY

FIELD OF THE INVENTION

The present invention relates generally to the ionization of molecules, which finds use for example in fields of analytical chemistry such as mass spectrometry (MS). More particularly, the invention relates to electron ionization and chemical ionization under low pressure conditions.

BACKGROUND OF THE INVENTION

Mass spectrometric analysis of a sample requires that the sample be provided in the form of a gas or molecular vapor and then ionized. Ionization may be performed in the mass analyzing portion of a mass spectrometer, i.e., in the same low-pressure region where mass sorting is carried out. Alternatively, ionization may be performed in an ion source (or ionization device) that is external to the low-pressure regions of the mass spectrometer. The resulting sample ions are then transmitted from the external ion source into the low-pressure mass analyzer of the mass spectrometer for further processing. The sample may, for example, be the output of a gas chromatographic (GC) column, or may originate from another source in which the sample is not initially gaseous and instead must be vaporized by appropriate heating means. The ion source may be configured to effect ionization by one or more techniques. One class of ion sources is gas-phase ion sources, which include electron impact or electron ionization (EI) sources and chemical ionization (CI) sources. In EI, a beam of energetic electrons is formed by emission from a suitable filament and accelerated by a voltage potential (typically 70 V) into the ion source to bombard the sample molecules. In CI, a reagent gas such as methane is admitted into the ion source conventionally at a high pressure (e.g., 1-5 Torr) and ionized by a beam of energetic electrons. The sample is then ionized by collisions between the resulting reagent ions and the sample. The resulting sample ions may then be removed from the ion source in the flow of the reagent gas and focused by one or more ion lenses into the mass analyzer. The mass spectrometer may be configured to carry out EI and CI interchangeably, i.e., switched between EI and CI modes according to the needs of the user.

High-pressure CI ion sources have been employed in conjunction with three-dimensional (3D) quadrupole ion trap mass spectrometers, and would also be applicable to two-dimensional (2D, or "linear") ion trap mass spectrometers (linear ion traps, or LITs). With either 3D ion traps or LITs, the sample is often introduced into the external ion source at an elevated temperature, such as when the sample is the output of a GC column. When the sample is provided at an elevated temperature, it is necessary to heat the ion source to prevent the sample from condensing in the ion source. However, because the ion source in this case is external to the ion trap and the ion trap itself is not utilized for ionization, it is not necessary to also heat the ion trap in this case, which is an advantage of external ion sources. Yet conventional external CI ion sources operate at high pressure as noted above, which is a disadvantage. High pressure CI requires the use of compressed gas cylinders to supply the reagent gas, as well as vacuum pumping stages between the ion source and the very low pressure ion trap. High pressure CI may increase contamination of the ion source, particularly in the area around the filament utilized to emit electrons where the high temperature causes pyrolysis of the reagent gas and contamination. High pressure also limits the choice of reagent gases able to be utilized and thus also limits the choice of chemical properties and reaction pathways available for CI. High pressure also limits the CI yield. Because ions are not trapped in a high-pressure ion source, the time in which the sample can interact and react with the reagent ions is limited by the volume of the ion source and the total gas flow rate. The gas flow rate in a high-pressure ion source is high, and thus the residence time of sample molecules in the ionization region where the reagent ions reside is low.

As an alternative to external ion sources, a 3D ion trap itself may be utilized to effect CI. In this case, the reagent ions are formed directly in the interior region defined by the electrodes of the 3D ion trap and the sample is subsequently introduced into the same interior region. In this case, the sample is ionized in this interior region and the resulting sample ions are subsequently scanned from the same interior region to produce a mass spectrum. Internal ionization is advantageous because it is performed at the low operating pressure of the ion trap. However internal ionization is disadvantageous because, unlike external ionization, it is necessary to heat the entire electrode assembly of the ion trap to prevent the sample from the GC from condensing on the electrodes. Operating the mass analyzer at elevated temperatures is disadvantageous in that it requires heating equipment and may produce inaccurate spectral data due to sample adsorption on the large surface area of the electrodes. Moreover, the electrode assembly must be fabricated by special techniques designed to enable the electrode assembly to reliably withstand repeated high-temperature operation.

In view of the foregoing, there is a need for providing apparatus and methods for implementing low-pressure EI and CI in which the sample is ionized in an ion processing device that is external to an ion trap utilized for mass analysis.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, a method for ionizing a sample by chemical ionization is provided. The sample and a reagent gas are flowed into an ion source at a pressure below 0.1 Torr. While maintaining the ion source at a pressure below 0.1 Torr, the reagent gas is ionized in the ion source by electron ionization to produce reagent ions. The sample is reacted with the reagent ions at a pressure below 0.1 Torr to produce product ions of the sample. The product ions are transmitted into an ion trap for mass analysis.

According to another implementation, a method is provided for operating an ion source. A first sample is ionized in the ion source by electron ionization to produce first sample ions, while maintaining the ion source at a pressure below 0.1 Torr. The first sample ions are transmitted to an ion trap for mass analysis. While continuing to maintain the ion source at a pressure below 0.1 Torr, a reagent gas and a second sample are flowed into the ion source. The reagent gas is ionized in the ion source by electron ionization to produce reagent ions. The second sample is reacted with the reagent ions at a pressure below 0.1 Torr to produce product ions of the second sample. The product ions the product ions are transmitted into the ion trap for mass analysis.

According to another implementation, a mass spectrometry apparatus includes an ion source, a vacuum pump, first ion optics, an ion guide, second ion optics, and an ion trap. The ion source includes an ionization chamber and an electron source configured for directing an electron beam into the ionization chamber. The ionization chamber has one or more inlets for receiving a sample and reagent gas. The vacuum pump is configured for maintaining a pressure below 0.1 Torr in the ionization chamber. The ion guide includes a plurality of guide electrodes surrounding an ion guide interior space communicating with the ionization chamber, and is configured for applying an ion-trapping electric field. The first ion optics are interposed between the ion source and the ion guide and configured for applying an electric potential barrier. The ion trap includes a plurality of trap electrodes surrounding an ion trap interior space communicating with the ion guide interior space, and is configured for mass-analyzing ions. The second ion optics are interposed between the ion guide and the ion trap and configured for applying an electric potential barrier.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

In the context of the present disclosure, the term "low pressure," as it pertains to a mass spectrometry system, refers generally to pressures below 0.1 Torr, while the term "high pressure" refers generally to pressures of 0.1 Torr or greater but more typically 1 Torr or greater. Implementations are described below in which electron ionization (EI) and chemical ionization (CI) are carried out at low pressure, i.e., below 0.1 Torr, and in some implementations in the range of 0.005 to just below 0.1 Torr.

Figure 1:
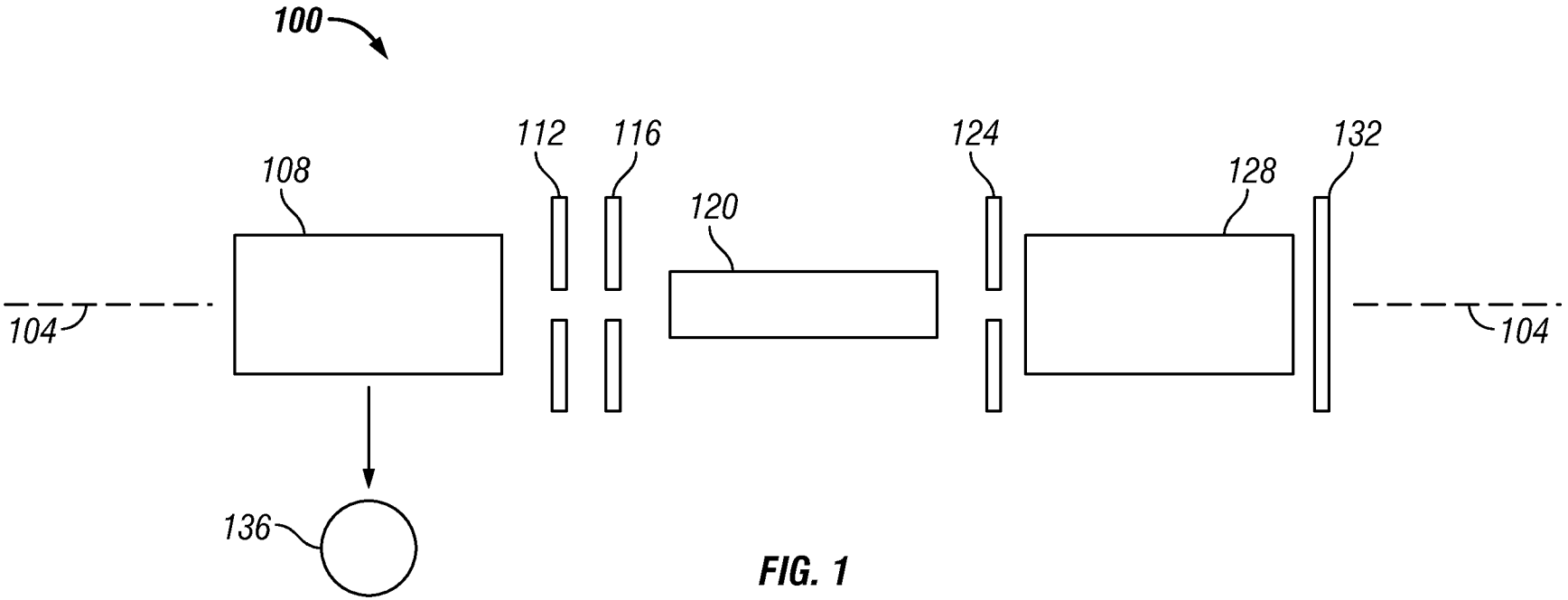
FIG. 1 is a simplified block diagram of an example of a mass spectrometry (MS) system in which certain aspects of the present teachings may be implemented.

FIG. 1 is a simplified block diagram of an example of a mass spectrometry (MS) system 100 (or apparatus, device, instrument, etc.) in which certain aspects of the present teachings may be implemented. The general flow of sample-based material and ions is in the direction from left to right in FIG. 1. For illustrative purposes, this direction will be referred to as the sample/ion flow direction and is conceptualized along a longitudinal axis 104 about which certain components of the MS system 100 are arranged. Along this direction, the MS system 100 generally includes an external ion source 108, an ion source lens 112, an ion guide entrance lens 116, an ion guide 120, an ion trap entrance lens 124, an ion trap 128, and an ion trap exit electrode 132. The MS system 100 may be considered as including an EI device (the ion source 108), a CI device (the ion guide 120, or the combination of the ion source 108 and the ion guide 120), and a mass analyzing device (the ion trap 128), with various ion optics positioned as needed relative to these devices, including first ion optics interposed between the ion source 108 and the ion guide 120 and second ion optics interposed between the ion guide 120 and the ion trap 128. In addition, a vacuum system is provided for maintaining the MS system 100 at the low pressures contemplated herein.

The ion source 108 is configured for ionizing reagent gases for CI of sample molecules. Alternatively, the ion source 108 is configured for carrying out either EI or CI on sample molecules at the selection of the user, i.e., may be switched between an EI mode of operation to a CI mode of operation. Depending on the nature or origin of the sample material and its propensity to condense, the ion source 108 may include an appropriate heating device (not shown). For instance, when a sample is eluted from a GC column, a heating device will preferably be employed. In the case of CI, a reagent gas and a sample are admitted at low pressure into the ion source 108 by any suitable means. For example, a vacuum pumping stage including a vacuum pump 136 may be provided at the ion source 108. For simplicity, the enclosures needed to maintain the low pressures in the various regions of the MS system 100 are not shown. The low pressure in the ion source 108 depends on the pumping speed of the vacuum pump 136 and the gas conductance of the ion source 108. The gas conductance is determined by the openness of the structure of the ion source 108. For low-pressure operation, inlets and outlets of the ion source 108 may be sized large, relative to conventional high-pressure ion sources, to facilitate maintaining a reduced pressure. This configuration results in high gas conductance and, in conjunction with the low pressure, a low total gas flow rate that increases residence time and ionization yield.

The ion source 108 includes any suitable means for generating an electron beam and directing the electron beam into the interior space where the reagent gas and the sample molecules reside, one example of which is described below in conjunction with FIGS. 7 and 8. Reagent ions are formed by EI in the ion source 108 and then focused by the ion source lens 112 and the ion guide entrance lens 116 into the ion guide 120. According to the present implementation, CI occurs in the ion guide 120, as described in more detail below in conjunction with FIG. 6. The ion guide 120 may have any known configuration. In one example, the ion guide 120 includes a set of axially elongated ion guide electrodes (e.g., rods) that define an interior region where CI takes place. Alternating voltages of RF frequency, or a combination of alternating and direct voltages, are applied to opposite pairs of the ion guide electrodes to form a transverse ion trapping field (transverse or orthogonal to the longitudinal axis 104), whereby ions of selected masses (or more accurately, mass-to-charge ratios or m/z ratios) may be confined to an elongated region immediately surrounding the longitudinal axis 104 and selectively prevented from escaping the ion guide 120 along transverse paths. The multi-electrode structure of the ion guide 120 is more open than the structure of the ion source 108. Hence, the gas conductance is higher and pressure is lower in the ion guide 120 than in the ion source 108. Due to the axially elongated structure of the ion guide 120, the number of reagent ions able to be trapped is an order of magnitude higher than in a 3D trap conventionally utilized for in-trap ionization. Consequently, the reagent ion concentration and resulting yield of sample ions by CI are high when utilizing the ion guide 120 in accordance with the present teachings.

Ions passing through the ion guide 120 are focused by the ion trap entrance lens 124 into the ion trap 128. In one alternative, the ion trap 128 may be located in a separately pumped vacuum chamber that is separated from the chamber of the ion source 108 by the ion trap entrance lens 124. In this alternative, ions may be transported from the ion trap entrance lens 124 to the ion trap 128 by means of a second ion guide (not shown). In either case, low-pressure conditions are maintained throughout the MS system 100 from the ion source 108 to the ion trap 128.

Figure 2:
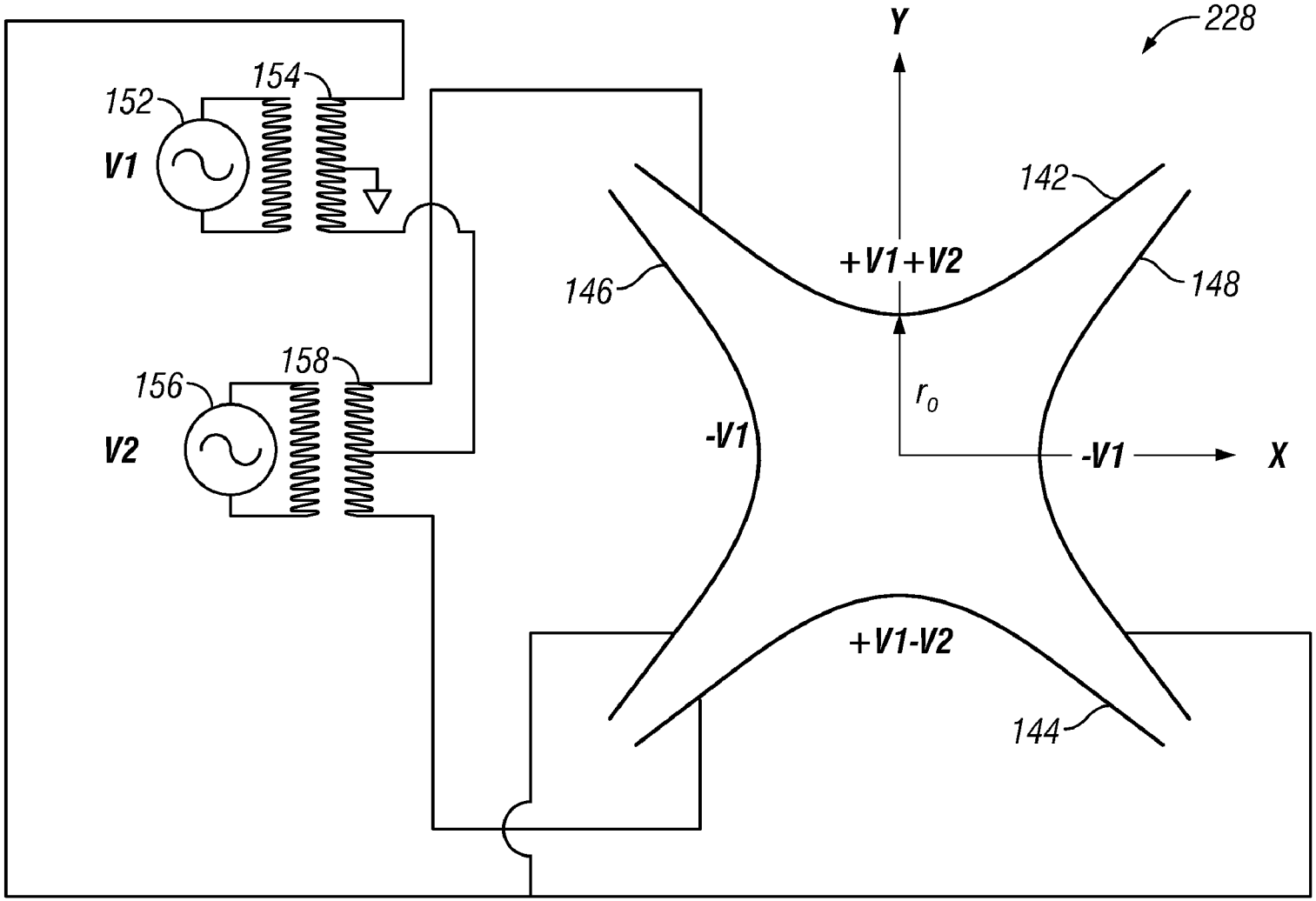
FIG. 2 is a cross-sectional view in a transverse plane of a linear ion trap (LIT) that may be utilized in an MS system according to the present disclosure.
Figure 3:
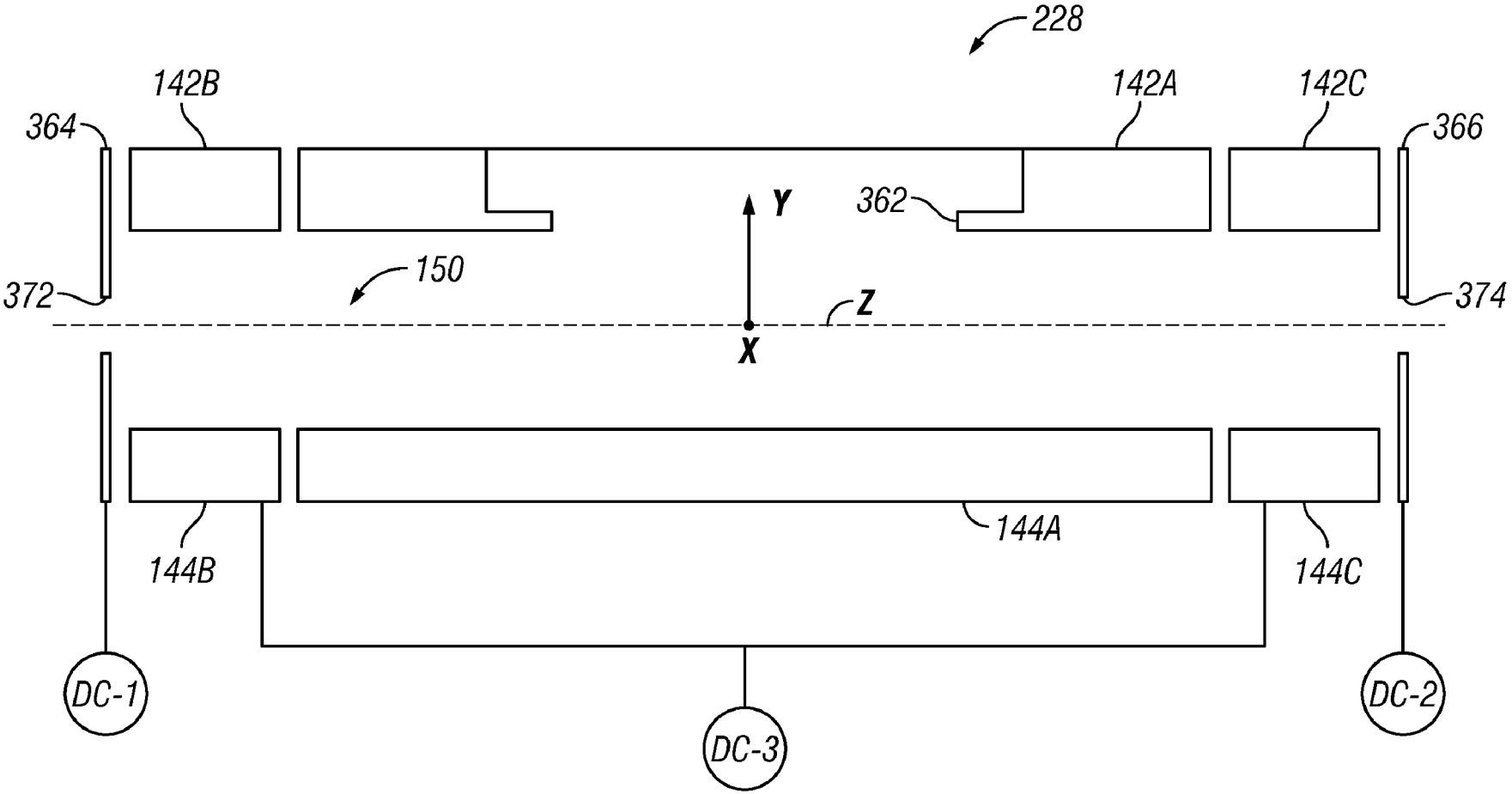
FIG. 3 is a cross-sectional view in a longitudinal plane of the LIT illustrated in FIG. 2.
Figure 4:
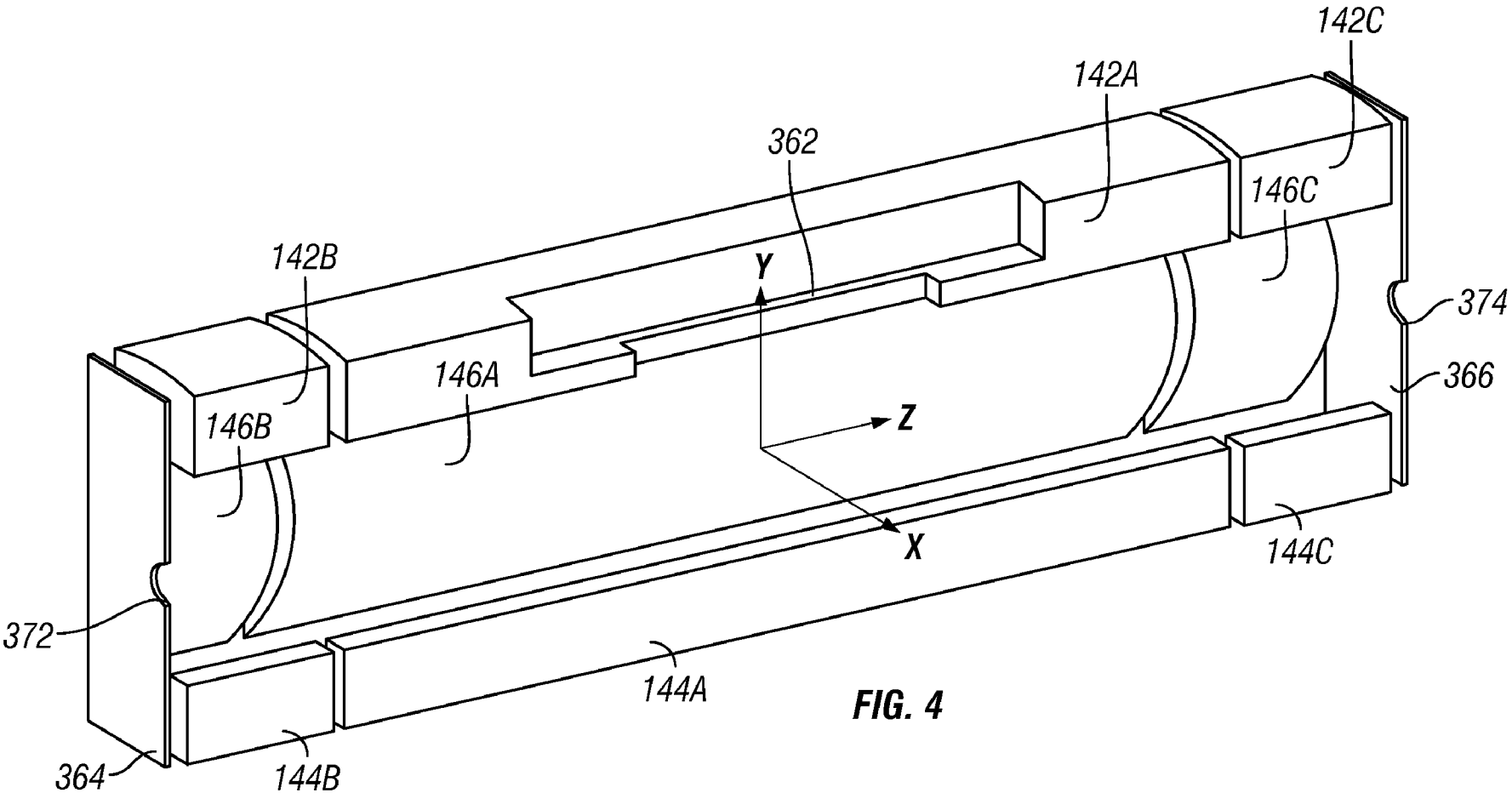
FIG. 4 is a cut-away perspective view of a portion of the LIT illustrated in FIG. 2.

The ion trap 128 may be a 3D ion trap or a linear ion trap (LIT). FIGS. 2-4 illustrate non-limiting examples of a LIT 228. Specifically, FIG. 2 is a cross-sectional view in a transverse plane of the LIT 228, FIG. 3 is a cross-sectional view in a longitudinal plane of the LIT 228, and FIG. 4 is a cut-away perspective view of the LIT 228 illustrating some of its electrodes.

FIG. 2 illustrates the electrode structure of the LIT 228 and some of its associated circuitry. The electrode structure includes an arrangement of four axially elongated, hyperbolic electrodes 142, 144, 146, 148. The arrangement is such that the electrodes 142 and 144 constitute an opposing pair and the other electrodes 146 and 148 likewise constitute an opposing pair. The electrode pair 142, 144 may be electrically interconnected and the electrode pair 146, 148 may be electrically interconnected by any suitable means. The electrodes 142, 144, 146, 148 are arranged about a central, longitudinal axis of the LIT 228. In the present example, the central axis is arbitrarily taken to be the z-axis which, from the orientation of FIG. 2, is represented by a point. The cross-section of the electrode structure lies in a radial or x-y plane orthogonal to the central z-axis. The central z-axis is more evident in the cross-sectional side view of another embodiment illustrated in FIG. 3. To form the linear geometry, the electrodes 142, 144, 146, 148 are structurally elongated along the z-axis and radially spaced from the z-axis in the x-y plane. The inside surfaces of opposing electrode pairs 142, 144 and 146, 148 face each other and cooperatively define an axially elongated interior space or region 150 of the LIT 228. The structural or geometric center of the interior region 150 is generally coincident with the central z-axis. As shown in FIG. 3, one or more of the electrodes 142, 144, 146, 148 may include an ion exit aperture 362 to enable collection and detection of ions of selected m/z ratios ejected from the interior region 150 in a radial or transverse direction relative to the central axis. The exit aperture 362 may be axially elongated as a slot.

As shown in FIG. 2, the cross-section of each electrode 142, 144, 146, 148 may be hyperbolic. The term "hyperbolic" is intended to also encompass substantially hyperbolic profiles (i.e., not precisely hyperbolic shapes). As alternatives to hyperbolic sheets or plates, the electrodes 142, 144, 146, 148 may be structured as cylindrical rods as in many quadrupole mass filters, or as flat plates. In these latter cases, the electrodes 142, 144, 146, 148 may nonetheless be employed to establish an effective quadrupolar electric field in a manner suitable for many implementations. The electrodes 142, 144, 146, 148 may be symmetrically arranged about the z-axis such that the radial spacing of the closest point of each electrode 142, 144, 146, 148 to the z-axis (i.e., the apex of the hyperbolic curvature) is given by a constant value $r_0$, and thus $r_0$ may be considered to be a characteristic dimension of the electrode structure. In some implementations, it may be desirable for one or more of the electrodes 142, 144, 146, 148 to deviate from an ideal hyperbolic shape or arrangement, or for the spacing between an electrode pair to be "stretched" from their ideal separation, or for electrical means to be implemented, for the purpose of producing multipole electric field components of higher order than a basic quadrupole field pattern. Details of the structure and operation of these types of LITs are described in U.S. Pat. No. 7,034,293, assigned to the assignee of the present disclosure.

FIG. 2 further illustrates a voltage source 152 of any suitable design that is coupled with the electrodes 142, 144, 146, 148 such that a main potential difference V1 of suitable magnitude and frequency is applied between the interconnected electrode pair 142, 144 and the other interconnected electrode pair 146, 148. For instance, the voltage source 152 may apply a voltage of +V1 to the electrode pair 142, 144 and a voltage of −V1 to the other electrode pair 146, 148. In some embodiments, voltage source 152 may be coupled with electrodes 142, 144, 146, 148 by a transformer 154 as illustrated in FIG. 2. The application of voltage source 152 to the electrode structure results in the formation of a quadrupolar electric field effective for trapping stable ions of a selected m/z range in the interior region 150 in accordance with the general, simplified expression $\Phi=U+V\cos(\Omega t)$. That is, the voltage source 152 provides at least a fundamental alternating (AC) potential V but may also provide an offsetting direct (DC) potential U having a zero or non-zero value. Whether an ion can be trapped in a stable manner by the quadrupole trapping field depends of the m/z value of the ion and the trapping parameters (amplitude V and frequency Ω) of the field being applied. Accordingly, the range of m/z values to be trapped can be selected by selecting the parameters at which the voltage source 152 operates.

As a general matter, the particular combination of electrical components such as loads, impedances, and the like required for implementing transfer functions, signal conditioning, and the like as appropriate for the methods disclosed herein are readily understood by persons skilled in the art, and thus the simplified diagram shown in FIG. 2 is considered sufficient to describe the present subject matter. The circuit symbol designating the voltage source 152 in FIG. 2 is intended to represent either an AC voltage source or the combination of an AC voltage source in series with a DC voltage source. Accordingly, unless otherwise indicated herein, terms such as "alternating voltage," "alternating potential," "AC voltage," and "AC potential" as a general matter encompass the application of alternating voltage signals, or the application of both alternating and direct voltage signals. The voltage source 152 may be provided in any known manner, one example being an AC oscillator or waveform generator with or without an associated DC source. In some embodiments, the waveform generator is a broadband multi-frequency waveform generator. The frequency Ω of the AC component of the trapping field is in the radio frequency (RF) range.

The quadrupolar trapping or storage field generated by the voltage source 152 creates a restoring force on an ion present in the interior region 150. The restoring force is directed towards the center of the trapping field. As a result, ions in a particular m/z range are trapped in the direction transverse to the central z-axis, such that the motions of these ions are constrained in the x-y (or radial) plane. As previously noted, the parameters of the trapping field determine the m/z range of ions that are stable and thus able to be trapped in the field. Ions so trapped can be considered as being confined to a trapping region located within the interior region 150 of the electrode structure. The center of the trapping field is a null or near null region at which the strength of the field is at or near zero. Assuming that a pure quadrupolar field is applied without any modification, the center of the trapping field generally corresponds to the geometric center of the electrode structure (i.e., on the z-axis). The position of the trapping field relative to the z-axis may be altered in the manner disclosed in above-referenced U.S. Pat. No. 7,034,293.

Due to the geometry of the LIT 228 and the two-dimensional nature of the quadrupolar trapping field, an additional means is needed to constrain the motion of ions in the axial z direction to prevent unwanted escape of ions out from the axial ends of the electrode structure and to keep the ions away from the ends of the quadrupolar trapping field where field distortions may be present. The axial trapping means can be any suitable means for creating a potential well or barrier along the z-axis effective to reflect ion motions in either direction along the z-axis back toward the center of the electrode structure. As one example schematically shown in FIG. 3, the LIT 228 may include suitable conductive bodies axially located proximate to the front and rear ends of the electrode structure, such as an ion trap entrance lens 364 and an ion trap exit electrode 366. By applying DC voltages of suitable magnitudes to the entrance lens 364 and the exit electrode 366 on the one hand and a DC voltage of a different magnitude to the electrode structure on the other hand, a force will be applied to an ion that is directed along the z-axis of the electrode structure. Thus, ions will be confined along the x-axis and y-axis directions due to the alternating voltage gradient established by the voltage source 152 (FIG. 2), and along the z-axis by means of the DC potential applied between the electrode structure and the entrance lens 364 and exit electrode 366. The axial DC voltage may also be utilized to control the introduction of ions into the interior region 150.

In addition to the voltage source 152 used to generate the quadrupolar trapping field, another electrical energy input such as an additional voltage potential may be provided for resonantly exciting ions in a desired range of m/z ratios into a state that enables these ions to overcome the restoring force of the trapping field in a controlled, directional manner. In the example illustrated in FIG. 2, an additional voltage source 156 is provided to apply a supplemental alternating excitation potential V2 across an opposing electrode pair, for example across the electrodes 142 and 144. The voltage source 156 may be coupled to the electrodes 142, 144 through a transformer 158. The voltage sources 152 and 156 cooperate to apply a voltage of (+V1+V2) to the electrode 142 and a voltage of (+V1−V2) to the electrode 144. To eject ions, the amplitude of the trapping potential V1 (and the associated DC offset component of the quadrupolar field if provided) may be increased to scan the secular frequency of oscillation of the ions. Once the secular frequency of an ion of a given m/z ratio matches the frequency of the supplemental resonance potential V2, the ion is ejected from the trap for detection by any suitable ion detector. See U.S. Pat. No. 7,034,293, referenced above.

Referring to FIGS. 3 and 4, in some implementations, the previously described four elongated hyperbolic electrodes 142, 144, 146, 148 may be axially segmented, i.e., segmented along the z-axis, to form a set of center electrodes 142A, 144A, 146A, 148A; a corresponding set of front end electrodes 142B, 144B, 146B, 148B; and a corresponding set of rear end electrodes 142C, 144C, 146C, 148C. The front and rear electrodes 148B and 148C are not actually shown in the drawings, but it will be understood that the front and rear electrodes 148B and 148C are inherently present, are shaped like the other electrodes shown, and are essentially mirror images of the front and rear electrodes 146B and 146C shown in the cut-away view of FIG. 4. Typically, the front end electrodes 142B, 144B, 146B, 148B and the rear end electrodes 142C, 144C, 146C, 148C are axially shorter than the center electrodes 142A, 144A, 146A, 148A. In each electrode set, opposing electrodes are electrically interconnected to form electrode pairs as previously described. In some implementations, the fundamental voltage V1 (FIG. 2) that forms the quadrupolar trapping field is applied between the electrode pairs of the front electrodes 142B, 144B, 146B, 148B and the rear electrodes 142C, 144C, 146C, 148C as well as the center electrodes 142A, 144A, 146A, 148A. The entrance lens 364 is axially located proximate to the front end of the front electrodes 142B, 144B, 146B, 148B, and the exit electrode 366 is axially located proximate to the rear end of the rear electrodes 142C, 144C, 146C, 148C.

In the segmented implementation illustrated in FIG. 3, DC bias voltages can be applied in any manner suitable for providing a potential barrier along the z-axis (positive for positive ions and negative for negative ions) to constrain ion motion along the z-axis. The DC axial trapping potential can be created by one or more DC sources. For example, a voltage DC-1 may be applied to the entrance lens 364 and a voltage DC-2 may be applied to exit electrode 366. An additional voltage DC-3 may be applied to all four electrodes of both the front electrode set 142B, 144B, 146B, 148B and the rear electrode set 142C, 144C, 146C, 148C. Alternatively, the voltage DC-1 could be applied to the front end electrodes 142B, 144B, 146B, 148B, the voltage DC-2 applied to the rear end electrodes 142C, 144C, 146C, 148C, and the voltage DC-3 applied to the center electrodes 142A, 144A, 146A, 148A. The entrance lens 364 has an entrance aperture 372 so that the entrance lens 364 can be used as a gate for admitting ions into the interior region 150 along the z-axis at a desired time by appropriately adjusting the magnitude of voltage DC-1. For example, an initially large gating potential DC-1' impressed on the entrance lens 364 may be lowered to the value DC-1 to allow ions having a kinetic energy sufficient to exceed the potential barrier on the entrance lens 364 to enter the electrode structure. The voltage DC-2, which normally is greater than the voltage DC-1, prevents ions from escaping out from the back of the electrode structure. After a predetermined time, the potential on the entrance lens 364 may again be raised to the value DC-1' to stop additional ions from entering the trap. The exit electrode 366 may likewise have an exit aperture 374 for any number of purposes, such as for removing ions or gases from the LIT 228 along the axial direction.

In some implementations, the voltage source 156 (FIG. 2) employed to apply the supplemental excitation potential V2 is a broadband multi-frequency waveform signal generator. The broadband multi-frequency waveform signal may, for example, be applied across the opposing pair of electrodes 142, 144 (or, in the segmented case, the opposing pair of center electrodes 142A, 144A) that includes the exit aperture 362, with the frequency composition selected to remove ions from the trap by resonance ejection at desired times.

Figure 5:
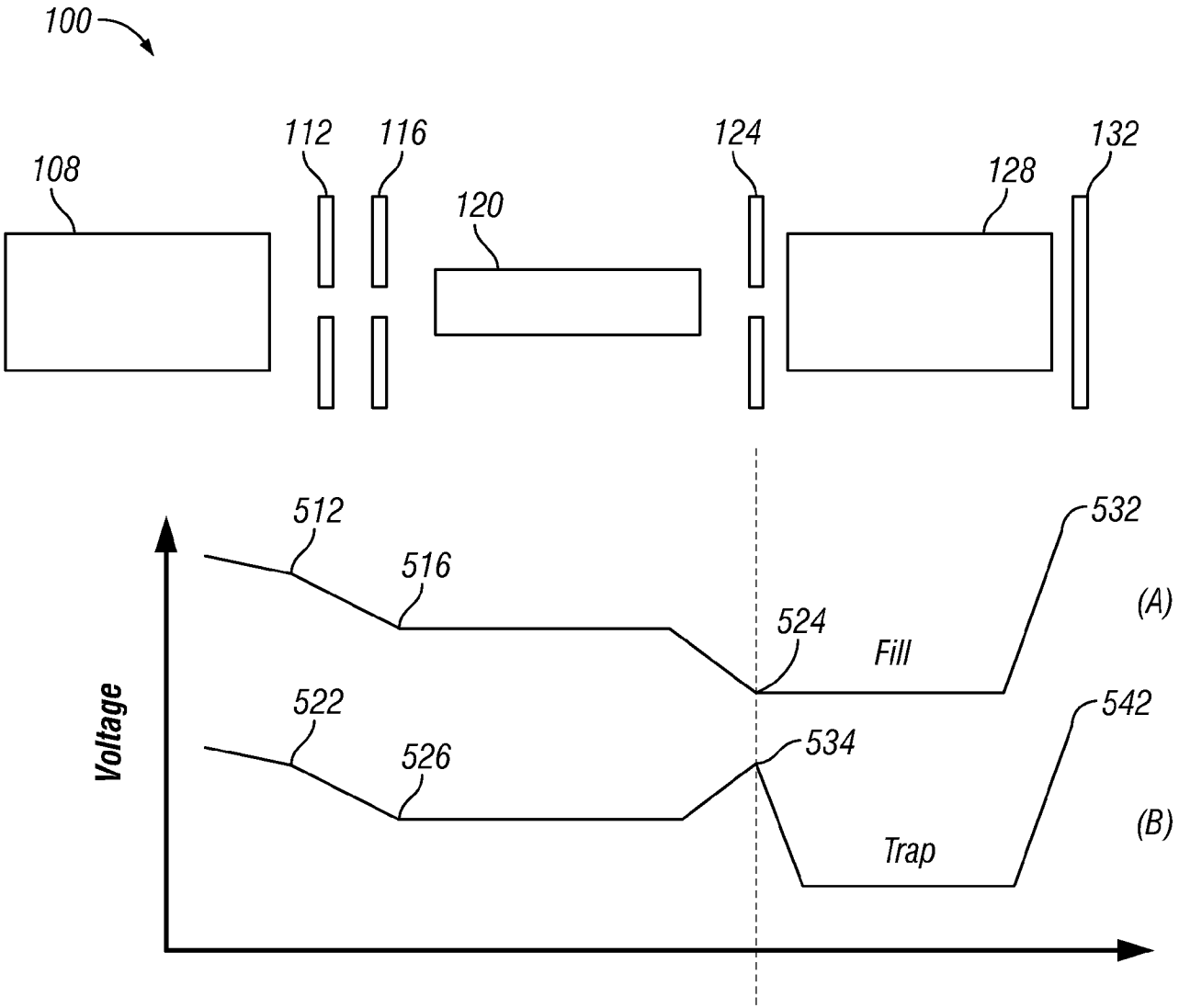
FIG. 5 is a block diagram of the MS system illustrated in FIG. 1, and two plots A and B of voltages applied to the components of the MS system as a function of position along a sample/ion flow direction during an ion filling stage (plot A) and an ion trapping stage (plot B) of a low-pressure EI process according to the present disclosure.

FIG. 5 is a block diagram of the MS system 100 illustrated in FIG. 1, and two plots A and B of voltages applied to the components of the MS system 100 as a function of position along the sample/ion flow direction during an ion filling stage (plot A) and an ion trapping stage (plot B) of a low-pressure EI process. FIG. 5 shows how sample ions formed by EI in the ion source 108 are focused by the ion source optics 112 and the ion guide entrance lens 116 into the ion guide 120. Plot A specifically shows the electrode voltages utilized to inject sample ions into the ion trap 128 for mass analysis. In plot A (filling stage), point 512 corresponds to the voltage applied at the ion source lens 112, point 516 corresponds to the voltage applied at the ion guide entrance lens 116, point 524 corresponds to the voltage applied at the ion trap entrance lens 124, and point 532 corresponds to the voltage applied at the ion trap exit electrode 132. In plot B (trapping stage), point 522 corresponds to the voltage applied at the ion source lens 112, point 526 corresponds to the voltage applied at the ion guide entrance lens 116, point 534 corresponds to the voltage applied at the ion trap entrance lens 124, and point 542 corresponds to the voltage applied at the ion trap exit electrode 132. It will be appreciated that plot A appears above plot B, and both plot A and plot B are illustrated using the same voltage and position axes, only as a matter of convenience to comparatively illustrate the differences in voltage magnitudes at different positions along the MS system 100 during each respective stage of operation. That is, the appearance of plot A above plot B should not be interpreted as indicating that the voltages applied at various points during the filling stage (plot A) are all higher than the voltages applied to the same points during the trapping stage (plot B).

Referring to plot A of FIG. 5, the potential energy of the sample ions is decreasing from the ion source 108 to the ion trap 128, which causes the sample ions to increase their kinetic energy and enter the interior region of the trap electrodes along the axis of the electrodes. The transverse force in the ion trap 128 provided by the electric trapping field described above prevents the sample ions from escaping in the radial direction. The large repulsive DC voltage potential from the ion trap exit electrode 132 (point 532) causes the sample ions to be reflected back in the direction from which they entered the electrode structure of the ion trap 128. Collisions between the sample ions and a light buffer gas provided in the ion trap 128, such as helium, cause a decrease in the kinetic energy of the sample ions. The decrease in kinetic energy prevents the sample ions, traveling in the direction from which they entered the ion trap 128, from escaping in the axial direction because of the potential barrier at the entrance of the ion trap 128.

Referring to plot B, after a predetermined time the voltage potential of the ion trap entrance lens 124 is increased (point 534) to form a potential barrier that prevents additional sample ions from the ion guide 108 from entering the ion trap 128. The sample ions residing in the ion trap 128 are now confined in the axial direction by DC potential barriers formed by the ion trap entrance lens 124 (point 534) and the ion trap exit electrode 132 (point 542), and in the transverse direction by the alternating voltage gradient from the trap electrodes. Other variations on the trap geometry are known such as described above in conjunction with FIGS. 3 and 4, in which case short sections of trap electrodes are added to each end of the center trap electrodes, the same RF voltage may be applied to all trap electrodes, a common DC potential may be applied to the short electrode set at each end, and a common DC potential may be applied to the center electrode set that is different from the common DC potential applied to the short electrode sets. This allows the DC in the main (or center) electrode set to be at a lower voltage potential than the end electrodes, thus forcing the sample ions to reside along the axis in only the region of the center electrodes.

Once trapped, the sample ions can be scanned out of the ion trap 128 through an aperture in one of the trap electrodes by known means such as, for example, described above as well as in above-referenced U.S. Pat. No. 7,034,293, to form an EI mass spectrum.

Figure 6:
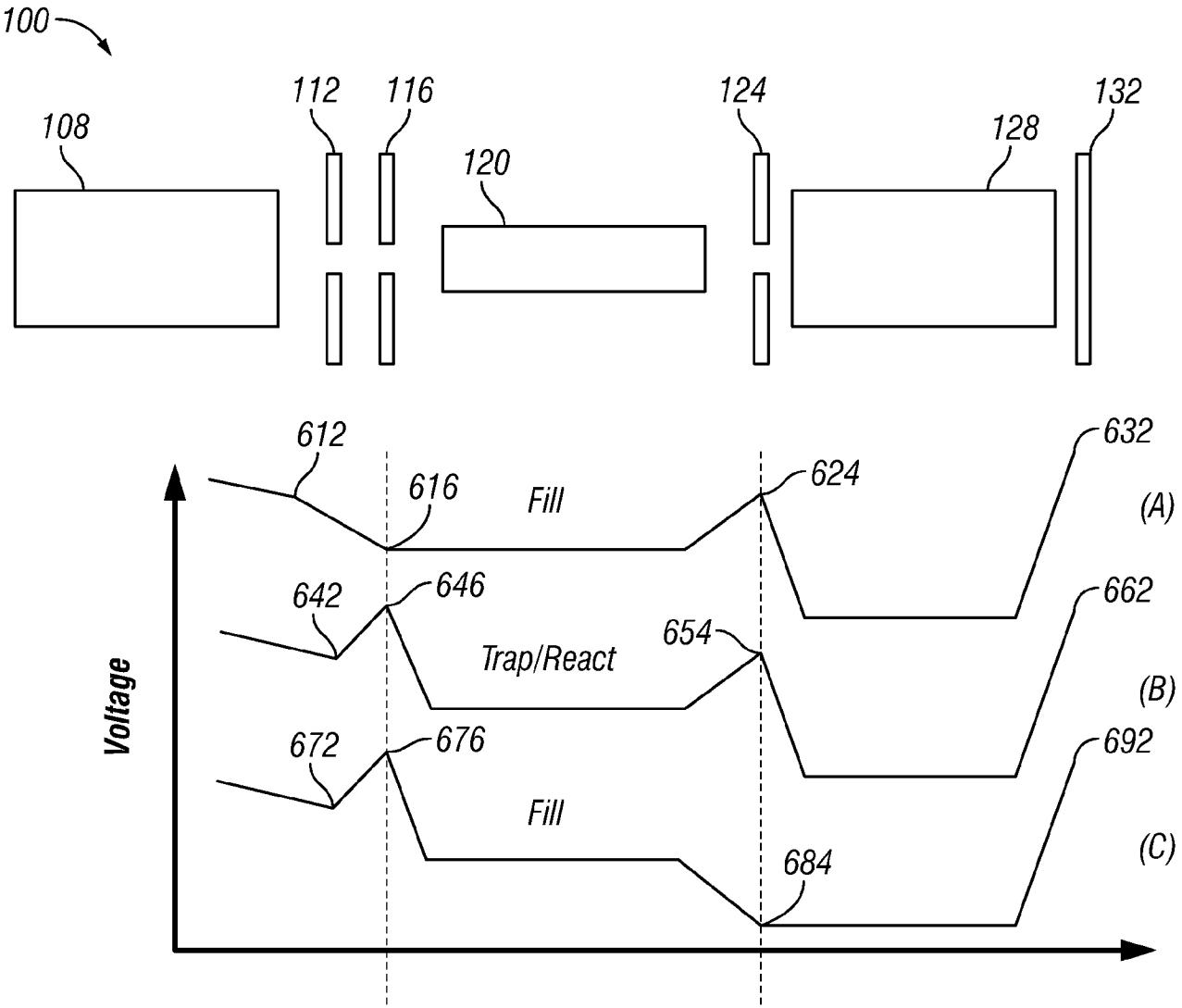
FIG. 6 is a block diagram of the MS system illustrated in FIG. 1, and three plots A, B and C of voltages applied to the components of the MS system as a function of position along the sample flow direction during a reagent ion filling stage (plot A), a reagent ion trapping/sample reacting stage (plot B), and a sample product ion filling stage (plot C) of a low-pressure CI process according to the present disclosure.

FIG. 6 is a block diagram of the MS system 100 illustrated in FIG. 1, and three plots A, B and C of voltages applied to the components of the MS system 100 as a function of position along the sample/ion flow direction during a reagent ion filling stage (plot A), a reagent ion trapping/sample reacting stage (plot B), and a sample product ion filling stage (plot C) of a low-pressure CI process. In plot A (ion guide filling stage), point 612 corresponds to the voltage applied at the ion source optics 112, point 616 corresponds to the voltage applied at the ion guide entrance lens 116, point 624 corresponds to the voltage applied at the ion trap entrance lens 124, and point 632 corresponds to the voltage applied at the ion trap exit electrode 132. In plot B (trap/react stage), point 642 corresponds to the voltage applied at the ion source optics 112, point 646 corresponds to the voltage applied at the ion guide entrance lens 116, point 654 corresponds to the voltage applied at the ion trap entrance lens 124, and point 662 corresponds to the voltage applied at the ion trap exit electrode 132. In plot C (ion trap filling stage), point 672 corresponds to the voltage applied at the ion source optics 112, point 676 corresponds to the voltage applied at the ion guide entrance lens 116, point 684 corresponds to the voltage applied at the ion trap entrance lens 124, and point 692 corresponds to the voltage applied at the ion trap exit electrode 132. Like in FIG. 5, it will be appreciated that plot A appears above plot B and plot B above plot C, and all of plots A, B and C are illustrated using the same voltage and position axes, only as a matter of convenience to comparatively illustrate the differences in voltage magnitudes at different positions along the MS system 100 during each respective stage of operation. That is, the appearance of plot A above plot B and plot B above plot C should not be interpreted as indicating that the voltages applied at various points during the reagent ion filling stage (plot A) are all higher than the voltages applied to the same points during the trapping/reacting stage (plot B), or that the voltages applied at various points during the trapping/reacting stage (plot B) are all higher than the voltages applied to the same points during the sample filling stage (plot C).

For CI, a reagent gas such as methane is admitted into the ion source 108 at low pressures (less than 0.1 Torr) along with the sample. EI of the reagent gas and the sample occurs in the ion source 108. The ions are removed from the ion source 108 and focused into the ion guide 120 by applying the voltages shown in plot A. In the present example, a carrier gas such as helium from the ion source 108 flows from the ion source 108 and initially enters the ion guide region where it serves as the buffer gas to effect collision cooling of the ion kinetic energy in the ion guide 120, thereby allowing the reagent ions and sample ions to be trapped in the axial direction in the ion guide 120. After a predetermined time the voltage potential of the ion guide entrance lens is increased (point 646), as shown in plot B, and further formation of ions in the ion source 108 is inhibited by deflecting the ionizing electron beam out of the ion source 108, as described in more detail below. The ion guide 120 now contains a mixture of sample ions and reagent ions formed by the EI that was carried out in the ion source 108.

In high-pressure CI, the reagent ions are formed in great excess relative to the sample ions because the pressure of the reagent gas is so much higher than the pressure of the sample. By contrast, in low-pressure CI as described herein the relative abundance of the sample ions and the reagent ions formed during the EI stage is much closer. Ideally, the spectrum resulting from the reaction of the CI reagent ion and the neutral sample to form (usually) the protonated molecular ion of the sample molecule would only have the sample ions formed by the CI reaction and the remaining CI reagent ions. However, inevitably there are also some ions formed by EI of the sample. These EI sample ions result in a spectrum that is a mixture of CI and EI. It is undesirable for sample ions formed by EI to be mixed in with the spectrum of ions formed by CI in the ion guide 120. Hence, it is desirable to selectively remove the unwanted sample ions formed by EI (generally found at higher mass) from the reagent ions (generally found at lower mass) and from the ion guide 120, and consequently isolate the reagent ions in the ion guide 120, before the sample is ionized by CI. In the present context, it will be understood that the term "sample" refers to neutral sample molecules that are to be ionized by CI in the ion guide 120, as distinguished from the sample ions produced by EI in the ion source 108. In one advantageous implementation, the ion guide 120 has a quadrupole electrode structure similar to that of the ion trap 228 illustrated in FIG. 2, or another suitable multipole electrode structure such as hexapole, octopole, or higher. A supplemental multi-frequency waveform may be applied to a pair of opposing electrodes of the ion guide 120 to resonantly eject all ions that have secular frequencies that match frequency components in the waveform. By constructing the frequency composition of the waveform in a specific manner, ions of mass-to-charge ratios (m/z) exceeding a specified value will absorb energy from the applied supplemental frequencies and increase the amplitude of their oscillation until they strike the ion guide electrodes and are lost from the ion guide 120. This technique may be employed to eject all of the sample ions from the ion guide 120. The remaining ions below the specified m/z value are all reagent ions, which under the low-pressure conditions may be trapped in the ion guide 120 for a predetermined time period sufficient for reaction by CI to occur.

In the present example, the sample exits the ion source 108 through a front aperture thereof and flows into the ion guide 120, wherein the sample reacts with the reagent ions (now isolated from the previously produced sample ions) to form product ions of the sample (sample ions formed by CI, or "sample CI ions"). After a predetermined reaction period, the reagent ions may be removed from the ion guide 120 by any suitable technique. For example, the amplitude of the RF voltage on the ion guide 120 may be increased to a level that makes the reagent ions unstable in the ion guide 120 and thereby causes them to be ejected from the ion guide 120 in the direction of the ion guide electrodes, leaving only the sample ions formed by CI in the ion guide 120. Next, the voltage potential of the ion trap entrance lens 124 (point 684) is reduced to allow the sample ions formed by CI to move from the ion guide 120 into the ion trap 128 for further processing such as mass analysis, as shown in plot C of FIG. 6.

As an alternative to removing unwanted EI sample ions from the ion guide 120 with the use of a multi-frequency broadband waveform, the amplitude of the RF trapping voltage applied to the ion guide 120 may be lowered. This is particularly useful when multipoles of 6 or 8 or higher are used. Higher order multipole ion guides can simultaneously trap a larger mass range. All ion guides have a minimum mass than can be trapped. Ions below this "low mass cutoff" mass are below the stability limit for the given electrode geometry (rod diameter and spacing), trapping frequency and RF trapping amplitude. Ions below the mass cutoff will be unstable and will not be trapped. Ions above the mass cutoff will be trapped, but as the mass becomes very large the trapping potential will become very shallow and the trapping force will become very weak. If the ion guide 120 is filled will large amounts of low mass ions (i.e. the reagent ions) the resulting space charge will cause the high mass ions to be removed from the ion guide 120 because the trapping force is too weak. Setting the mass cutoff significantly below the lowest mass reagent ion (the lowest voltage possible without affecting the trapping of the highest mass reagent ion) will be optimum for high mass removal. This technique is less efficient than utilizing waveforms, but has the advantage of being much simpler and does not require additional electronic circuitry. This technique may be implemented by the following sequence. The RF voltages on the ion guide 120 are adjusted to a low value to allow trapping of the reagent ions, but not allow trapping of the EI sample ions. The RF trapping voltage is then adjusted to a higher value to allow the trapping of higher mass product ions formed by CI. The product ions may then be released from the ion guide 120 into the ion trap 128 for mass analysis in the manner described above.

Figure 7:
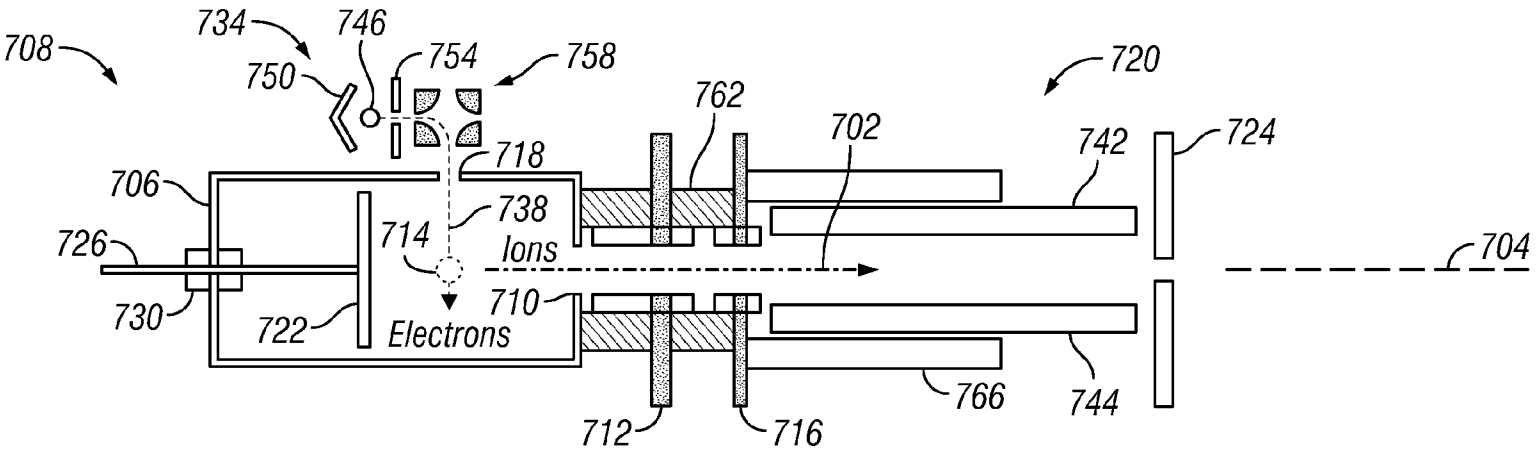
FIG. 7 is a cross-sectional view of an example of an ion source according to the present disclosure.
Figure 8:
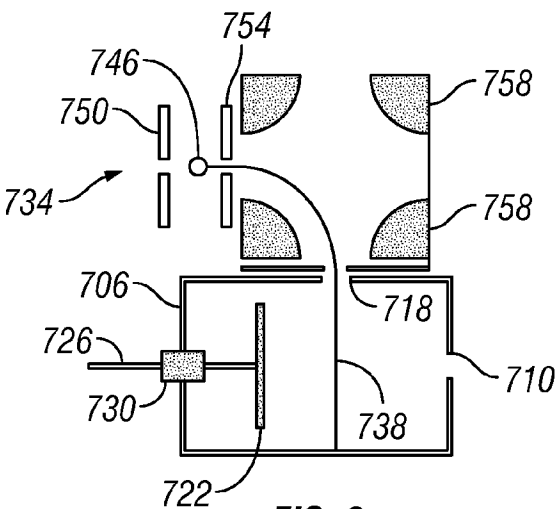
FIG. 8 is a cross-sectional view of an electron source and an ionization chamber according to the present disclosure, and includes a software-generated simulation of deflection of an electron beam.

FIG. 7 is a cross-sectional view of an example of an ion source 708 according to the present disclosure. The ion source 708 includes several components successively positioned along a sample/ion flow direction 702 and along a longitudinal axis 704. These components include an ionization chamber 706, an ion source lens 712, an ion guide entrance lens 716, an ion guide 720, and an ion trap entrance lens 724 (or ion guide exit lens). The ionization chamber 706 is defined by any suitable structure or housing that has a sample/ion exit aperture 710 positioned about the longitudinal axis 704, a sample entrance aperture 714 oriented transverse to the longitudinal axis 704, and an electron entrance aperture 718 also oriented transverse to the longitudinal axis 704. The sample entrance aperture 714 may also be utilized to flow reagent gas into the ionization chamber 706, or alternatively a separate reagent gas entrance (not shown) may be provided. Thus, the sample entrance aperture 714 communicates with a suitable sample source (not shown) such as a GC, or communicates with both a sample source and a suitable reagent gas source (not shown). An ion repeller electrode 722 is positioned in the ionization chamber and communicates with an electrical connection 726 supported by an electrical insulator 730 at a wall of the ionization chamber 706. The ion repeller electrode 722 may generally be located with the sample/ion exit aperture 710 along the common longitudinal axis 704. An electron source 734 is configured to direct an ionizing electron beam 738 into the ionization chamber 706 along an axis transverse to the longitudinal axis 704. In the present example, the electron source 734 includes a filament 746 composed of any suitable thermionic material and interposed between an electron repeller electrode 750 and an electron focusing electrode 754. Additionally, the electron source 734 includes an electron deflecting device. In the present example, the electron deflecting device includes a set of electron deflector electrodes 758 mounted in a quadrupole arrangement. The ion source lens 712 and the ion guide entrance lens 716 may be mounted by one or more electrical insulators 762. The ion guide 720 may be mounted by similar means, and in the present example includes a quadrupole arrangement of ion guide electrodes 742, 744, two of which are shown in FIG. 7.

In operation, the filament 746 is heated by a filament power supply (not shown) to generate electrons. Application of an appropriate voltage potential between the electron repeller electrode 750 and the electron focusing electrode 754 directs the electrons toward the deflector electrodes 758, with the electron focusing electrode 754 focusing the electrons as the electron beam 738. Application of appropriate voltages to the deflector electrodes 758 deflects the electron beam 738 through the electron entrance aperture 718 and into the ionization chamber 706. Deflection of the electron beam 738 is further shown in FIG. 8, which is a cross-sectional view of the electron source 734 and the ionization chamber 706 and includes a SIMION® software-generated simulation of the electron beam deflection. When it is desired not to form ions in the ion source 708, the voltage potentials applied to the deflector electrodes 758 may be reversed so as to deflect the electron beam 180 degrees in the opposite direction. Ions generated in the ionization chamber 706 may be transmitted into the ion guide 720 via the ion source lens 712 and the ion guide entrance lens 716, and the sample may be ionized in the ion guide 720 via reaction with reagent ions, in the manner described earlier in this disclosure. The electrical insulator 762 that aligns the ion source lens 712 and the ion guide entrance lens 716 also forms a gas-tight seal between the ionization chamber 706 and the ion guide 720, thereby ensuring that the sample molecules are directed from the ionization chamber 706 into the ion guide 720 for reaction with the reagent ions. In some implementations, the ion source 708 may further include a shroud 766 surrounding at least the entrance end of the ion guide 720 and abutting the ion guide entrance lens 716. The shroud 766 reduces gas conductance in the direction transverse to the longitudinal axis 704 so as to better confine the gas in the ion guide 720 and increase the efficiency of the reaction between the sample and the reagent ions.

The present disclosure thus provides apparatus and methods for selectively implementing low-pressure EI and CI in an external ion source and subsequent mass analysis in a separate mass analyzer. The mass analyzer may be either a 3D or linear ion trap-based instrument. The linear arrangement of the external EI/CI apparatus and ion guide taught herein is particularly well-suited for use in conjunction with linear ion trap mass spectrometers. It can also be seen that ions may be formed by EI or alternatively by CI utilizing the same device, without the need to break vacuum or change mechanical components, thus enabling quick and easy switching between EI and CI modes of operation in accordance with the needs of the user. For example, a first sample may be ionized by EI (such as by the process described above in conjunction with FIG. 5) and then subjected to mass analysis, and subsequently a second sample may be ionized by CI (such as by the process described above in conjunction with FIG. 6) and then subjected to mass analysis, or vice versa.

Moreover, ionization is carried out at low pressure and product ions are subsequently injected into the mass analyzer. In this way, the mass analyzer may be maintained at a low temperature during operation. This allows the trapping electrode assembly of the ion trap to be fabricated by simpler means that otherwise would not be compatible with high-temperature operation, such as for example by gluing the trap electrodes to electrical insulators in a specified precise alignment. Additionally, the complexities associated with conventionally requiring the electrodes to be heated to prevent sample condensation and deleterious chromatographic results are avoided. Ionization performed in accordance with the present disclosure eliminates the need to heat the electrodes of the ion trap. As an example, the temperature of the ion source in which the sample gas is introduced may range from 100 to 300° C., while the temperature of the ion trap utilized for mass analysis may be substantially lower, such as below 150° C. or ranging from 60 to 150° C. In practice, the temperature of the ion trap needs only to be hot enough to initially bake off the adsorbed water (100-150° C.), and then the temperature can be lowered to a temperature above room temperature to stabilize the dimensions of the trap electrodes by having them thermostated at the above-room temperature.

In addition to conventional reagents such as methane, low-pressure ionization allows a wider variety of chemistries to be utilized as reagents, such as methanol, acetonitrile, etc., thereby making available a wider variety of ionizing strategies or fragmentation pathways. Low-pressure ionization also enables reagent ions to be trapped in a controlled manner and for a desired period of time, thereby enabling increased reaction time and ion yield.

It will be understood that apparatus and methods disclosed herein may be applied to tandem MS applications (MS/MS analysis) and multiple-MS ($MS^n$) applications. For instance, ions of a desired m/z range may be trapped and subjected to collisionally-induced dissociation (CID) by well known means using a suitable background gas (e.g., helium) for colliding with the "parent" ions. The resulting fragment or "daughter" ions may then be mass analyzed, and the process may be repeated for successive generations of ions. In addition to ejecting ions of unwanted m/z values and ejecting ions for detection, the resonant excitation methods disclosed herein may be used to facilitate CID by increasing the amplitude of ion oscillation.

It will also be understood that the alternating voltages applied in the embodiments disclosed herein are not limited to sinusoidal waveforms. Other periodic waveforms such as triangular (saw tooth) waves, square waves, and the like may be employed.

In general, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for ionizing a sample by chemical ionization, the method comprising:

flowing the sample and a reagent gas into an ion source at a pressure below 0.1 Torr;

while maintaining the ion source at the pressure below 0.1 Torr, ionizing the reagent gas in the ion source by electron ionization to produce reagent ions;

transmitting the reagent ions into an ion guide;

flowing the sample from the ion source into the ion guide;

reacting the sample with the reagent ions in the ion guide at a pressure below 0.1 Torr to produce product ions of the sample; and transmitting the product ions into an ion trap for mass analysis.

2. The method of claim 1, comprising maintaining the ion trap at a temperature below 150° C. while transmitting the ions.

3. The method of claim 1, comprising trapping the reagent ions for a desired time while reacting the sample with the reagent ions.

4. The method of claim 1, comprising trapping the reagent ions in the ion guide for a desired time while reacting the sample with the reagent ions, by applying a time-varying quadrupolar electric field in the ion guide.

5. The method of claim 1, comprising transmitting sample ions produced by electron ionization in the ion source into the ion guide along with the reagent ions, and removing the sample ions from the ion guide before reacting the sample with the reagent ions.

6. The method of claim 5, wherein removing the sample ions comprises resonantly ejecting the sample ions from the ion guide by applying a supplemental time-varying electric field between a pair of opposing electrodes of the ion guide.

7. The method of claim 5, wherein removing the sample ions comprises adjusting time-varying trapping voltages applied to electrodes of the ion guide to a low value sufficient to trap the reagent ions and insufficient to trap the sample ions.

8. The method of claim 1, comprising, after producing the product ions, removing the reagent ions from the ion guide.

9. A method for operating an ion source, the method comprising:

ionizing a first sample in the ion source by electron ionization to produce first sample ions, while maintaining the ion source at a pressure below 0.1 Torr;

transmitting the first sample ions to an ion trap for mass analysis;

while continuing to maintain the ion source at a pressure below 0.1 Torr, flowing a reagent gas and a second sample into the ion source;

ionizing the reagent gas in the ion source by electron ionization to produce reagent ions;

transmitting the reagent ions into an ion guide;

flowing the second sample from the ion source into the ion guide;

reacting the second sample with the reagent ions in the ion guide at a pressure below 0.1 Torr to produce product ions of the second sample; and transmitting the product ions into the ion trap for mass analysis.

10. The method of claim 9, comprising trapping the reagent ions for a desired time while reacting the second sample with the reagent ions.

11. The method of claim 9, comprising transmitting sample ions produced by electron ionization in the ion source into the ion guide along with the reagent ions, and removing the sample ions from the ion guide before reacting the second sample with the reagent ions.

12. A mass spectrometry apparatus, comprising:

an ion source comprising an ionization chamber and an electron source configured for directing an electron beam into the ionization chamber, the ionization chamber having one or more inlets for receiving a sample and reagent gas;

a vacuum pump configured for maintaining a pressure below 0.1 Torr in the ionization chamber;

an ion guide comprising a plurality of guide electrodes surrounding an ion guide interior space communicating with the ionization chamber, and configured for applying an RF ion-trapping electric field;

first ion optics interposed between the ion source and the ion guide and configured for applying an electric potential barrier;

an ion trap comprising a plurality of trap electrodes surrounding an ion trap interior space communicating with the ion guide interior space, and configured for mass-analyzing ions; and second ion optics interposed between the ion guide and the ion trap and configured for applying an electric potential barrier.

13. The mass spectrometry apparatus of claim 12, wherein the electron source comprises an electron deflector configured for selectively deflecting the electron beam away from the ionization chamber.

14. The mass spectrometry apparatus of claim 12, wherein the ion guide is configured for removing reagent ions from the ion guide interior space.

15. The mass spectrometry apparatus of claim 12, wherein the plurality of guide electrodes comprises at least four axially elongated electrodes configured for applying a two-dimensional ion-trapping field.

16. The mass spectrometry apparatus of claim 12, comprising an electrical insulator interposed between the ion source and the ion guide in a gas-tight manner, wherein the first ion optics are mounted to the electrical insulator.

17. The mass spectrometry apparatus of claim 12, comprising a shroud axially extending from the first ion optics and surrounding at least a portion of the guide electrodes.

18. The mass spectrometry apparatus of claim 12, wherein the ion trap is a two-dimensional or three-dimensional ion trap.

* * * * *